United States Patent [19]

Lattion

[11] Patent Number: 4,727,983

[45] Date of Patent: Mar. 1, 1988

[54] BOBBIN LOADING ARRANGEMENT

[75] Inventor: André Lattion, Seuzach, Switzerland

[73] Assignee: Maschinenfabrik Rieter AG, Winterthur, Switzerland

[21] Appl. No.: 816,043

[22] Filed: Jan. 3, 1986

[30] Foreign Application Priority Data

Jan. 3, 1985 [GB] United Kingdom ..... 8500120

[51] Int. Cl.[4] ..... B65G 47/44

[52] U.S. Cl. ..... 198/360; 242/35.5 A; 57/270; 57/276

[58] Field of Search ..... 198/359, 360, 361; 193/14; 242/35.5 A; 57/268, 270, 276; 414/328, 397, 398

[56] References Cited

U.S. PATENT DOCUMENTS

| | | | |
|---|---|---|---|
| 3,331,487 | 7/1967 | Willoughby | 198/360 |
| 4,155,513 | 5/1979 | Maassen | 242/35.5 A |
| 4,570,865 | 2/1986 | Kawarabashi et al. | 242/35.5 A |

FOREIGN PATENT DOCUMENTS

| | | |
|---|---|---|
| 0126373 | 11/1984 | European Pat. Off. . |
| 0126352 | 11/1984 | European Pat. Off. . |
| 0127017 | 12/1984 | European Pat. Off. . |
| 464117 | 7/1935 | United Kingdom . |
| 1052187 | 12/1966 | United Kingdom . |
| 1369140 | 10/1974 | United Kingdom . |
| 1437294 | 5/1976 | United Kingdom . |
| 1516752 | 7/1978 | United Kingdom . |
| 2120287 | 11/1983 | United Kingdom . |

*Primary Examiner*—Joseph F. Peters, Jr.
*Assistant Examiner*—James M. Kannofsky
*Attorney, Agent, or Firm*—Michael J. Striker

[57] ABSTRACT

An arrangement for supplying bobbins to at least one tender which is situated at one of two loading stations that are disposed at opposite sides of an elongated textile machine from one another comprises a feeding chute which extends from a transfer location at a downward inclination to a distribution location, at which a diverting device is arranged and is operated to selectively divert the bobbins arriving at the distribution location into one or the other of two paths which lead from the distribution location to respective loading stations, depending on the presence of the tender to be loaded with the bobbins at the respective loading station. One of the two paths is advantageously formed by a continuation of the chute, while the other path commences at an opening of the bottom wall of the chute at the distribution location, which is closed by a movable wall in one of its positions, while the movable wall uncovers the opening in its other position and simultaneously blocks the entry of the bobbins into the continuation of the chute. The bobbins are supplied to the transfer location from a bulk container for the bobbins by an elevator in such orientation that the longitudinal axes of the bobbins extend parallel to the longitudinal axis of the machine.

11 Claims, 2 Drawing Figures

BOBBIN LOADING ARRANGEMENT

BACKGROUND OF THE INVENTION

The present invention relates to an arrangement for selectively supplying bobbins to a tender or to tenders for a textile machine, such as an open-end spinning machine.

Commonly owned published European patent applications Nos. 126,352, 126,373 and 127,017 disclose various aspects of a service tender for textile machines. The full disclosure of each of these prior patent applications is incorporated in the present application by reference. The present invention is concerned particularly, but not exclusively, with loading of cylindrical bobbins into a magazine on a tender as illustrated and described in those applications.

It is generally known to feed cylindrical bobbins individually from a "bulk" container therefor into a bobbin magazine of a service tender. Such feeding can be effected without great difficulty because the cylindrical bobbins can be made to roll in a controlled fashion in a direction at right angles to their longitudinal axes.

Furthermore, it has already been proposed to provide a double-sided textile machine with one bobbin-carrying service tender per side with a common bobbin feed system at the machine end—see for example U.S. Pat. No. 4,155,513. However, the bobbin feed system proposed in this patent is relatively complex.

SUMMARY OF THE INVENTION

Accordingly, it is a general object of the present invention to avoid the disadvantages of the prior art.

More particularly, it is an object of the present invention to provide an arrangement for supplying bobbins to at least one tender of a textile machine, especially a rotor spinning machine, at two different locations, which arrangement does not possess the disadvantages of known arrangements of a similar kind.

Still another object of the present invention is so to construct the arrangement of the type here under consideration as to be relatively simple in construction, inexpensive to manufacture, easy to install and use, and reliable in operation nevertheless.

It is yet another object of the present invention so to design the arrangement of the above type as to require only minor modifications of existing equipment.

In pursuance of these objects and others which will become apparent hereafter, one feature of the present invention resides in an arrangement for supplying bobbins to at least one tender situated at one of two loading stations disposed at opposite sides of an elongated textile machine from one another, this arrangement comprising means for sequentially delivering the bobbins to a distribution location arranged between the two loading stations; and means for selectively diverting the bobbins arriving at the distribution location for travel in that of two paths each leading to one of the loading station which terminates at the tender to be supplied with the bobbins at the respective loading station.

According to another aspect of the present invention, the delivering means includes a bulk receiver for a multitude of the bobbins, and an elevator operative for individually entraining the bobbins in the bulk container for joint travel therewith toward the distribution location. It is particularly advantageous when the delivering means includes an inclined chute extending transversely of the machine to the distribution location and having a surface on which the bobbins can roll toward the distribution location.

In this context, it is especially advantageous when the chute has a main portion terminating at the distribution location and an extension constituting a continuation of the main portion beyond the distribution location and at least partially delimiting one of the two paths. Then, it is further advantageous when the chute has a movable portion at the distribution location, the movable portion being movable between two positions in one of which it prevents and in the other of which it permits entry of the bobbins into the other of the two paths. Advantageously, the movable portion of the chute is so constructed and mounted that it blocks further movement of the bobbins into the extension of the chute in its other position.

According to another facet of the present invention, the delivering means includes a conveyor for transporting the bobbins with their axes parallel to the elongation of the machine to a transfer location, and a chute extending between the transfer location and the distribution location which is situated substantially centrally of the machine, the chute having an inclined bottom surface and being oriented transversely of the machine for the bobbins to roll on the inclined bottom surface from the transfer location to the distribution location.

Yet another advantageous feature of the present invention resides in that the arrangement further includes guiding means for the bobbins on the tender, such guiding means having an upstream portion which registers with the dowstream portion of one of the paths when the tender is at one of the loading stations, an with the downstream portion of the other path when the tender is a the other loading station.

Thus, it may be seen that the present invention provides a bobbin supply or loading system for loading bobbins into a bobbin magazine of a service tender for a textile machine. The system may comprise a bulk storage receptacle for bobbins to be loaded. Means may be provided for feeding bobbins sequentially from the receptacle to a transfer location and from there to a distribution location from which individual bobbins can be distributed to a service tender when the latter is suitably located relative to the loading system and to the textile machine. At the distribution location, means is provided for seletively directing the respective bobbin that has arrived at the distribution location in one of a plurality of directions, that is, into one of a plurality of different paths. In this manner, the loading system can be adapted for feeding bobbins to a service tender, or to a plurality of service tenders, in a plurality of different dispositions with respect to the textile machine, that is, at different loading stations. In the alternative, or additionally, the feeding means can deliver bobbins to selected ones of a plurality of transfer or distribution locations.

In its currently preferred form, the invention provides a delivering chute and means selectively operatable to define a plurality of delivery locations along the chute. The downstream end of the chute may provide one such delivery location and an operable and closable trapdoor may provide another such delivery location. When open, the trapdoor may be raised to block the chute and to re-direct the movement of the bobbin in the chute into the open ing left open after the trapdoor has been removed therefrom.

The term "bulk storage" as used in conjunction with the bobbin receptacle or container is intended to indicate that the recevier or container is capable of retaining or storing a substantially greater number of bobbins than the magazine of the service tender which is to be loaded by the loading system of the present invention. The feeding means advatageously includes an elevator arranged to deliver the bobbins sequentially from the bulk storage receptacle or container to the chute.

The novel features which are considered as characteristic of the invention are set forth in particular in the appended claims. The improved supplying arrangement for bobbins itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENT

Figure 1:
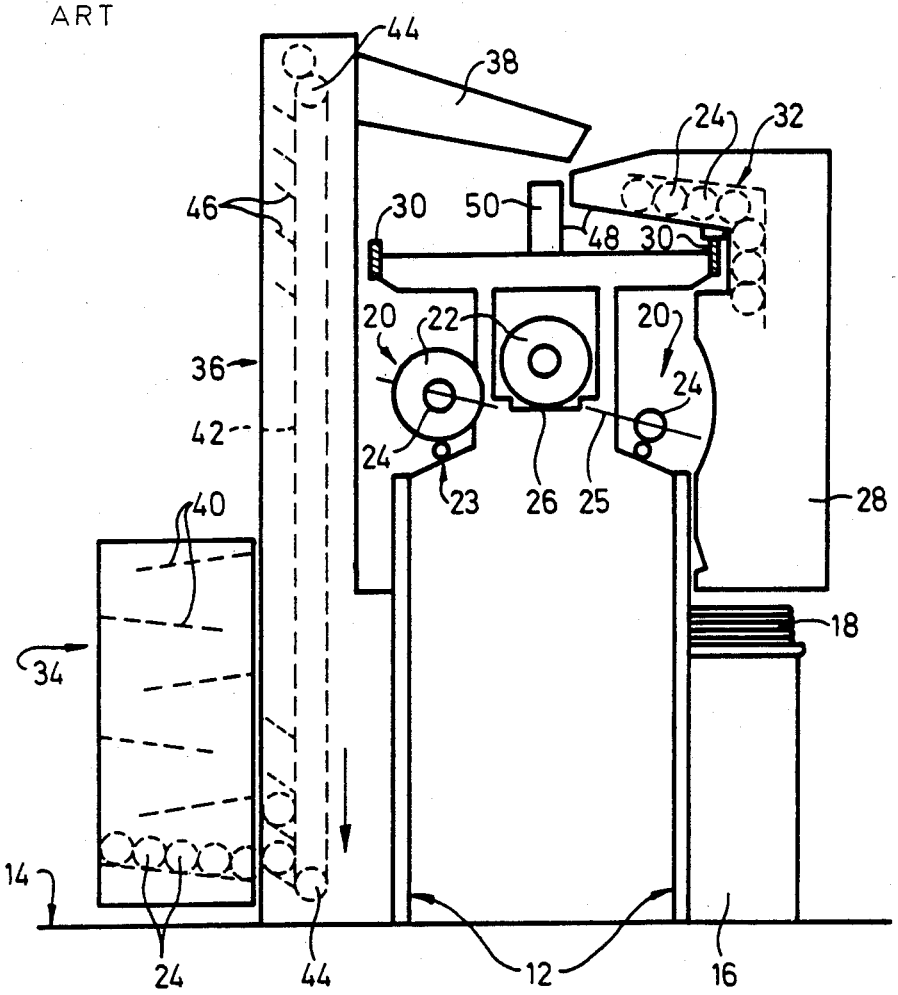
Fig.1 PRIOR ART
FIG. 1 is a quite simplified diagrammatic end elevational view of a known bobbin loading system for loading cylindrical bobbins into a bobbin-receiving magazine of a service tender of a spinning machine.

Referring now to the drawing in detail, and first to FIG. 1 thereof, it may be seen that it depicts a rotor sintering machine in an end elevational view as viewed from one end of the machine. This type of machine is well known in the art of spinning textile yarns, and thus only a very brief description of some aspects thereof will be provided herein.

The machine is elongated, extending a substantial distance at right angles to the plane of the drawing. Along each machine side, there is provided a plurality (usually approximately 100) of operating stations adapted to operate individually to spin respective textile yarns. The cross-sectional outline of the machine frame is shown at 12, standing on a suitable floor 14. The reference numeral 16 identifies a can which contains fiber sliver 18 which is fed to one of the operating stations on the right hand side of the machine as illustrated. In operation, a similar can is provided for each station. The yarn leaving the rotor spinning section (not illustrated) of that operating station is fed to a wind-up section 20 where it is wound into a package 22 on a cylindrical bobbin 24. During winding, the respective bobbin 24 is supported by a cradle 25 so that the bobbin 24 or the package forming thereon contacts a friction drive roll 23. When a package (or "cheese") is full, it is transferred to a conveyor belt 26 running longitudinally of the machine between the two rows of wind-up sections 20. FIG. 1 shows one package 22 on the conveyor 26; this package 22 has just been transferred to the conveyor 26 from the wind-up section 20 on the right hand side of the drawing. A similar package 22 has formed at the wind-up section 20 on the left hand side of the drawing, and will be transferred to the conveyor 26 as soon as that operating station can be attended to by an automatic service tender 28.

The tender 28 is supported on and guided by a rail 30 mounted on an upper portion of the machine frame 12. The rail 30 is U-shaped, the bend of the U being provided at the machine end opposite the end illustrated in FIG. 1. By movement along the rail 30, the tender 28 can be brought into operating alignment with any one of the operating stations.

The tender 28 has a suitable mechanism (not shown) for transferring a full package 22 from the wind-up section 20 of its operating station to the conveyor 26. The tender 28 further has a magazine 32 normally containing empty bobbin tubes 24, and a mechanism ( not shown) for transferring an individual bobbin tube 24 from the magazine 32 to the wind-up section 20 of an operating station from which a full package 22 has been removed. Details of such systems can be seen from the published European patent application No. 126,352 and will be omitted from the present application.

At the illustrated machine end, the rail 30 extends longitudinally of the machine frame 12 beyond the operating stations. When the magazine 32 is empty or partly empty, tender 28 can be caused by a control system (as described in published European patent application No. 126,373) to move along the rail 30 beyond the operating stations into a magazine loading position adjacent the one rail end. When the tender 28 has docked in the magazine loading position, a bobbin loading system can be operated to feed the bobbins 24 into the magazine 32 as will now be described.

The illustrated loading system comprises a carriage 34 adapted to run on rails on the floor 14, an elevator 36 and a chute 38. The elevator 36 is fixed relative to the frame 12 at a position directly opposite from the magazine loading position of the tender 28. The chute 38 is fixed to the upper end of the housing of the elevator 36 and extends therefrom across the machine to transfer the bobbins 24 from the elevator 36 into the magazine 32. The rail system on the floor 14 permits a machine attendant to roll the carriage 34 into and out of an operative relationship with the lower end of the elevator 36 on the side thereof facing away from the machine.

The carriage 34 includes a plurality of vertically spaced, inclined baffles 40. Each inclined baffle (except the lowermost) extends only partially across the carriage 34 so that the baffles 40 together define a zig-zag path along which the bobbins 24 can move successively to the lowermost baffle 40. The lowermost baffle 40 extends across the full width of the carriage 34 and leads the bobbins 24 to a position from which they are taken up successively by the elevator 36. Each bobbin 24 rolls down each inclined baffle 40, falling off of the lower end of the respective upper baffle 40 onto the baffle 40 situated below, until the last or lowermost baffle 40 leading to the elevator 36 is reached.

The elevator 36 comprises an endless belt 42 drivable around guide rolls 44 situated at the lower and upper ends of the elevator 36, respectively. The belt 42 carries projections 46 which define between themselves individual compartments which take up respective bobbins 24 from the carriage 34. The belt 42 is driven in a clockwise direction as indicated by the arrow, around the guide rolls 44. As each compartment passes from the ascending to the descending run of the belt 42, the respective bobbin 24 carried in that particular compartment is guided or simply falls into the chute 38 and rolls down the inclined bottom surface of the chute 38 into the magazine 32.

The control of the system in relatively simple. The bobbins 24 can be relied upon to roll as required down the baffles 40 and the chute 38. As described in the European application No. 126,352, the tender 28 includes a suitable monitoring device (not shown here) which monitors the state of filling of the magazine 32. Lines 48 from the tender 28 pass to a central duct 50 on the machine frame 12 and enable passage of energy and of information signals between the machine and the tender 28. When the tender 28 docks in the magazine loading position, that is, at the respective loading station, it issues a signal which causes operation of the elevator 36. Feeding of the bobbins 24 from the carriage 34 to the elevator 36 is automatic, provided that a free compartment is available in the elevator 36 and the carriage 34 still has bobbins 24 to feed.

Figure 2:
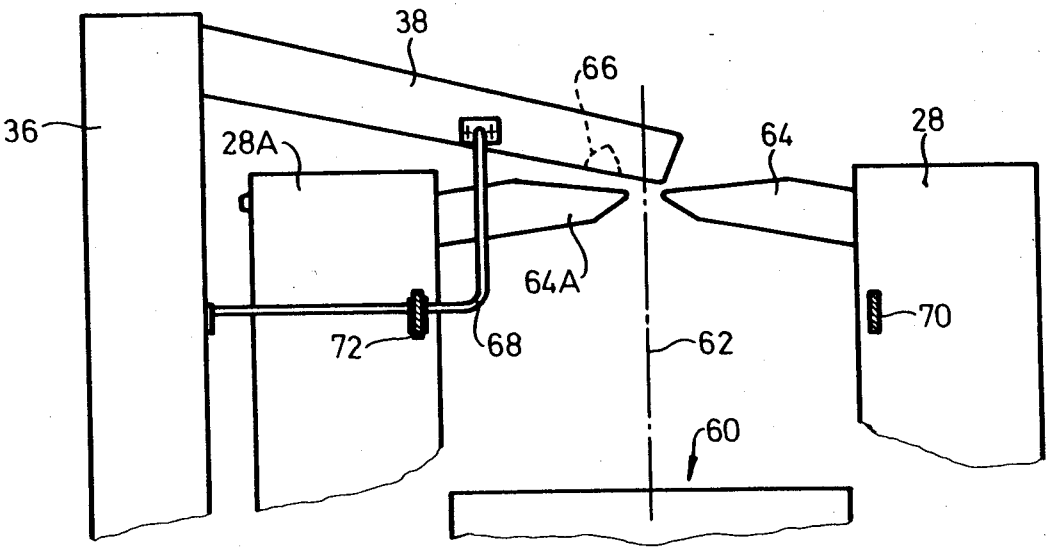
FIG. 2 is a view similar to that of FIG. 1 but showing a modification of the loading system in accordance with the present invention, which enables the system to supply bobbins selectively to a single tender or to two separate tenders at opposite sides of the textile machine.

FIG. 2 illustrates a modification in accordance with the present invention of the basic system of FIG. 1 which enables the same system to supply bobbins to each of two service tenders 28 and 28A serving respective opposite sides of the machine shown in FIG. 1. In this case, travel of each tender 28 and 28A around the curved portion of the rail 30 is blocked so that each tender 28 and 28A moves back and forth only along its own machine side.

Similar reference numerals, in some instances supplemented by the letter A for differentiation purposes, have been used to indicate those parts in FIG. 2 which are similar to those shown in FIG. 1. Thus it is believed unnecessary to describe further the elevator 36 or the two tenders indicated in outline at 28 and 28A. It will be noted, however, that the elevator 36 has been shifted slightly further away from the machine frame which is indicated in block at 60, so that sufficient space is provided for the left-hand tender 28A (as viewed in FIG. 2) to pass into its bobbin-loading position between the elevator 36 and the machine frame 60. The tenders 28 and 28A are of substantially identical construction.

It will be seen that the chute 38 still extends across the machine (approximately at right angles to the longitudinal central plane 62 of the machine) to a position approximately midway between the two machine sides. A bar 68 is provided to support the elongated chute 38.

Delivery of the bobbins 24 to the right-hand tender 28 occurs exactly as before. The bobbin-receiving chute 64 on the tender 28 extends in a cantilever fashion across the machine and is aligned with the chute 38 so as to form an extension thereof as considered in top plan view. The bobbins 24 delivered sequentially by the elevator 36 roll down the continuous sloping floor of the chute 38 and continue in the same direction after leaving the end of the chute 38, which defines the transfer location for delivery of the bobbins 24 to the chute 64.

The bobbin-receiving chute 64A of the tender 28A extends in the opposite direction to the chute 64. The ends of the chutes 64 and 64A lie on opposite sides of the central plane 62 of the machine. Thus they do not interfere with each other in any way.

At a position in the chute 38 corresponding to the bobbin-receiving opening in the chute 64A, the floor (not indicated) of the chute 38 has a raisable and lowerable trapdoor indicated in dashed lines at 66. For delivery of the bobbins 24 to the chute 64, the trapdoor 66 is lowered so that it forms a part of the continuously sloping floor leading to the end of the chute 38. For delivery of the bobbins 24 to the chute 64A, however, the trapdoor 66 is raised to the position indicated in dashed lines. The trapdoor 66 itself now acts as a block, preventing further movement of a bobbin 24 down the chute 38. The opening provided in the floor by raising of the trapdoor 66 defines a transfer or delivery location at which bobbins 24 blocked by the raised door 66 pass to chute 64A. The direction of movement of each such bobbin 24 is turned through about 90° at the trapdoor 66 and through a further 90° in the chute 64A.

Besides providing a very simple means for supplying bobbins 24 to two different tenders 28 and 28A as illustrated and described, the invention can be used to advantage when only one tender 28 is provided per machine as described with reference to FIG. 1. In this case, the suffix A merely indicates a different location of the same component. The tender 28 can be supplied with bobbins 24 at a loading position or station on either side of the machine. This can increase overall efficiency by reducing the travel distance required to reach the loading position from an arbitrary position along the rail 30.

The tenders 28 and 28A can be located simultaneously in their loading positions, but a loading operation for one tender 28 or 28A will be completed before loading of the other tender 28 or 28A is commenced. Sensors 70 and 72 are provided adjacent the respective loading positions to register the presence of a tender 28 or 28A therein. The "first" sensor initiated by arrival of a tender 28 or 28A supplies a signal to a microprocessor control system which checks the condition of the trapdoor 66 and controls an operating device (not shown) in dependence upon the current condition of the trapdoor 66 and the signal received from the sensor 70 or 72. The operating device may be in the form of a piston and cylinder unit, stepping motor or any other suitable actuating device.

The invention is not limited to details of the illustrated embodiment. In FIG. 2, the preferred embodiment uses both a change of transfer location (chute end, trapdoor 66) and a change of bobbin movement direction (along the line of the chute 38 or at 90° thereto) to differentiate delivery to tenders 28 and 28A. With a little added complication in the mechanical arrangements, either a change of location or a change of direction may suffice. For example, all bobbins 24 could be delivered at the end of the chute 38, but the direction of travel could be changed. Alternatively, all bobbins 24 could be delivered along the line of the chute 38, but at widely spaced locations therealong. The illustrated system has the advantage of uniform parts on the tenders 28 and 28A and a simple and reliable modification to the main chute 38. The trapdoor 66 could open downwardly instead of upwardly, but the advantageous chute blocking effect would not be obtained. The whole length of the chute floor between the elevator 36 and the nearer bobbin delivery point, that is, the point of transfer to the tender 28A in FIG. 2, could be movable downwardly to increase the slope of this floor portion and to interrupt feeding to the chute end. However, this would be a relatively complex alternative. The width of the chute 38 is preferably matched to the axial length of the bobbins 24 and the movable portion of the chute floor (in FIG. 2, the trapdoor 66) preferably extends across substantially the entire chute width.

It will be understood that each of the elements described above, or two or more together, may also find a useful application in other types of arrangements differing from the type described above.

While the invention has been illustrated and described as embodied in an arrangement for supplying bobbins to a tender of an elongated rotor spinning machine, it is not intended to be limited to the details shown, since various modifications and structural changes may be made without departing in any way from the spirit of the invention.

Without further analysis, the foregoing will so fully reveal the gist of the present invention that others can, by applying current knowledge, readily adapt it for various appplications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims;

I claim:

1. An arrangement for supplying bobbins to at least one tender situated at one of two loading stations disposed at opposite sides of a central longitudinal plane of an elongated textile machine from one another, comprising means for sequentially delivering the bobbins from one of the machine sides into a first path leading across the central longitudinal plane to the tender then sitauted at that of the two loading stations which is located at the other machine side; and means for selectively diverting the bobbins at a delivery location near the central longitudinal plane from said first path into a second path leading to the tender then situated at that of the loading stations which is located at the one machine side, the tender having a bobbin receiving member also extending to the delivery location near the central longitudinal plane and forming the second path into which the bobbins are diverted from the first path.

2. The arrangement as defined in claim 1, wherein said delivering means includes a bulk receiver for a multitude of the bobbins, and an elevator operative for individually entraining the bobbins in the bulk container for joint travel therewith toward said distribution location.

3. The arrangement as defined in claim 1, wherein said delivering means includes an inclined chute extending transversely of the machine to said distribution location and having a surface on which the bobbins can roll toward said distribution location.

4. The arrangement as defined in claim 3, wherein said chute has a main portion terminating at said distribution location and an extension forming a continuation of said main portion beyond said distribution location and at least partially delimiting one of said two paths, said extensions forming said receiving element of the tender.

5. The arrangement as defined in claim 4, wherein said chute has a movable portion at said distribution location, said movable portion being movable between two positions in one of which it prevents and in the other of which it permits entry of the bobbins into the other of said two paths.

6. The arrangement as defined in claim 5, wherein said movable portion of said chute blocks further movement of the bobbins into said extension of said chute in said other position thereof.

7. The arrangement as defined in claim 1, wherein said delivering means includes a conveyor for transporting the bobbins with their axes parallel to the elongation of the machine to a transfer location, and a chute extending between said transfer location and said distribution location which is situated substantially centrally of the machine, said chute having an inclined bottom surface and being oriented transversely of the machine for the bobbins to roll on said inclined bottom surface from said transfer location to said distribution location.

8. The arrangement as defined in claim 1, and further comprising guiding means on the tender having an upstream portion registering with the downstream portion of one of said paths when tender is at one, and with the downstream portion of the other of said paths when the tender is at the other, of said loading stations.

9. An elongated textile machine having a plurality of operating stations arranged along opposite machine sides and each operative for forming yarn packages on cylindrical bobbins; at least one service tender operative for servicing said operating stations; first and second bobbin loading stations situated directly opposite each other on opposite sides of the machine; delivering means arranged across said first bobbin loading station from the machine and operative for sequentially delivering cylindrical bobbins; a chute extending at a downward inclination so that the cylindrical bobbins can roll therein from said delivering means above said first bobbin loading station to a delivery location associated with said second bobbin loading stations; diverting means selectively operable for diverting bobbins rolling in said chute to a delivery location associated with said first bobbin loading station; and at least one bobbin receiving member mounted on said at least one tender and operative for receiving said bobbins at least at one of said delivery locations when said tender is at the associated one of said first and second bobbin loading stations, said chute extending to a point near central longitudinal plane of the machine, and said bobbin receiving member also extending to a point near the central longitudinal plane so that the delivery of bobbins take place in the delivery locations near the central longitudinal plane of the machine.

10. The machine as defined in claim 9, wherein said delivery locations are aligned with one another transversely of the machine and are situated at opposite sides of a longitudinal central plane of the machine.

11. The machine as defined in claim 9, wherein said chute includes a bottom wall and has an opening in said bottom wall at said delivery location associated with said first bobbin loading stations; and wherein said diverting means includes a trapdoor mounted in said chute for movement between one position in which it covers said opening and unblocks said chute for the bobbins to roll thereover to said delivery location associated with said second bobbin loading station, and a second position in which it blocks said chute and uncovers said opening for the bobbins to fall through said opening to said delivery location associated with said first bobbin loading station.

* * * * *